US005505560A

United States Patent [19]

Brown et al.

[11] Patent Number: 5,505,560

[45] Date of Patent: Apr. 9, 1996

[54] FLUID TRANSFER SYSTEM FOR AN OFFSHORE MOORED FLOATING UNIT

[75] Inventors: Paul A. Brown, Nice; Leendert Poldervaart, La Turbie, both of France

[73] Assignee: Offshore Energie Development Corporation (OECD), Monaco Cedex, Monaco

[21] Appl. No.: 141,063

[22] Filed: Oct. 26, 1993

[51] Int. Cl.[6] ..... F21B 43/013; B63B 35/00

[52] U.S. Cl. ..... 405/195.1; 405/169

[58] Field of Search ..... 405/195.1, 169–171, 405/158

[56] References Cited

U.S. PATENT DOCUMENTS

| | | | |
|---|---|---|---|
| 4,182,584 | 1/1980 | Panicker et al. | 405/195.1 X |
| 4,478,586 | 10/1984 | Gentry et al. | 405/195.1 X |
| 4,793,737 | 12/1988 | Shotbolt | 405/195.1 X |
| 4,906,137 | 3/1990 | Maloberti et al. | 405/170 X |
| 5,197,826 | 3/1993 | Korloo | 405/195.1 X |

*Primary Examiner*—Dennis L. Taylor
*Attorney, Agent, or Firm*—Young & Thompson

[57] ABSTRACT

To compensate considerable movements between a floating unit and a seabed structure which are interconnected by a fluid line, the invention proposes to embody this fluid line in an upper catenary and a lower portion. The upper catenary is on the one hand supported by the floating structure and on the other hand by a subsurface buoy. The lower portion is on the one hand supported by the subsurface buoy and on the other hand connected to the seabed structure. This lower portion is provided with buoyancy beads. In this way it is possible that the floating structure may be displaced a considerable distance relative to the seabed structure. In addition, the system can withstand considerable environmental loading. This means that the connection between the seabed structure and floating unit can be maintained even under unfavorable conditions.

6 Claims, 1 Drawing Sheet

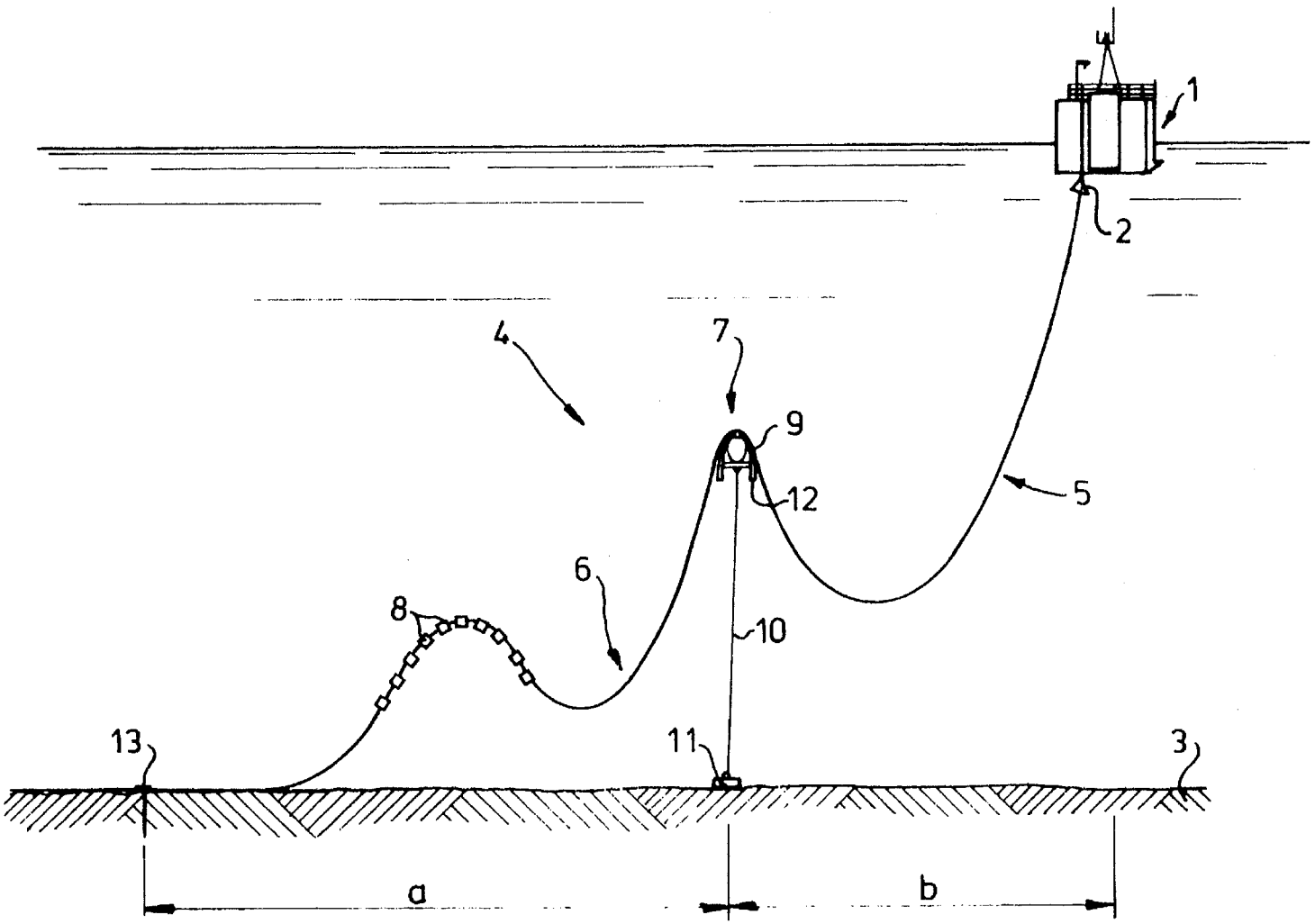
1
2
3
4
5
6
7
8
9
10
11
12
13
a
b

FLUID TRANSFER SYSTEM FOR AN OFFSHORE MOORED FLOATING UNIT

BACKGROUND OF THE INVENTION

The invention relates to a fluid transfer system for an offshore moored floating unit.

Often a fluid connection has to be made between a sea bed structure and a floating unit using a fluid line assembly. This floating unit can move relative to the seabed structure. This movement will be more considerable, with respect to the water depth, if the environment in which the unit is present is relatively harsh. To prevent overloading it is known to realize the fluid connection between the unit and the seabed structure in such a way that a relative displacement of the unit and the seabed structure is possible. For example a fluid line is used which has a wave shape to permit a relative movement.

As a final safety measure, a fluid line assembly connecting the seabed structure and the floating unit can be disconnected from the floating unit if the weather conditions become very unfavourable. However, it is clear that such a disconnection has dramatic consequences on the efficiency of a production well and is therefore not always the preferred option.

In the PCT-application W0 87/05876 a fluid line assembly is disclosed comprising a lower catenary connecting a seabed structure to a subsurface buoy, and an upper catenary connecting said subsurface buoy to a floating unit. The lower catenary comprises a flexible fluid line which extends downwards from the subsurface buoy to the seabed and lies from the contact point with the seabed over a distance of this seabed to the seabed structure. To-and-fro movement of the subsurface buoy is accommodated by the flexible line and results in movement of this flexible line over the sea bottom. On the one hand this could damage the flexible line adjacent to the place of contact with the sea bottom by wear. On the other hand deviation of the subsurface buoy is restricted because otherwise damage will occur to the fluid line through overbending or overstretching. A maximum of 15° movement relative to the vertical is generally accepted. The subsurface buoy is connected through e fluid line with a floating unit.

According to one aspect the invention aims to provide a fluid line assembly which permits larger relative movements between a floating unit and a fixed seabed structure.

According to another aspect of the invention it is aimed that the subsurface buoy can be realized with e buoyancy body having lower buoyancy properties, so both reducing its costs end the mass of the Clump weight placed on the seabed which keeps the buoyancy body in position using a line or tether.

SUMMARY OF THE INVENTION

According to the invention a fluid transfer system for an offshore moored floating unit is provided comprising fluid line assembly forming the fluid communication between said floating unit and a structure on the seabed, said fluid line assembly comprising an upper catenary extending from said floating unit to a subsurface buoy, and a lower portion extending from said subsurface buoy to the seabed structure, wherein said lower portion is provided with buoyancy means.

In general, the lower portion has a greater extent in horizontal direction then the upper catenary.

Buoyancy means are according to a further aspect of the invention preferably provided in the lower half of the lower portion. These buoyancy means can comprise buoyancy beads.

The invention will be further elucidated referring a preferred embodiment which is discussed below in detail and which is shown in the figure, wherein a schematic view is given of the fluid line assembly according to the invention.

DETAILED DESCRIPTION OF A PREFERRED EMBODIMENT

In the figure reference number 1 refers to a floating structure, such as a production platform, tanker or any other floating device known in the art. The floating unit is in fluid connection with a seabed structure 13, such as a well head. This connection is realized by a fluid line assembly 4 comprising an upper portion 5 and a lower catenary 6. Upper catenary 5 comprises a flexible fluid line provided at its extremity with a connector 2. This connector 2 can be optionally connected end disconnected from the floating unit 1. The fluid line of the upper catenary is connected to e subsurface buoy 7 comprising a curved guiding channel 12 which is connected to the buoyancy body 9. This subsurface buoy 7 is connected through line 10 with a clump weight 11 positioned on the seabed 3. Lower portion 6 also comprises a flexible fluid line from subsurface buoy 7 to seabed structure 13.

The lower portion 6 is provided with buoyancy beads 8. The horizontal extent (a) of the lower portion 6 is normally greater than the horizontal extent (b) of upper catenary 5.

Through the use of buoyancy beads 8 in lower portion 6 the fluid line will be elevated from the seabed preventing damage of the fluid line due to overbending, overstretching or sliding over the seabed during to-and-fro movement of subsurface buoy 7. Said movement may be generated by movement of floating structure 1 or by direct loading due to waves. Because of the design the subsurface buoy 7 can be displaced over a considerable distance and the fluid line assembly 4 can withstand more harsh conditions than in the prior art. Line 10 can be displaced from the vertical position up to 45°. The fluid line assembly shown here is of particular interest in harsh environments end/or waters having a relatively small depth. Through the use of buoyancy beads 8 the buoyancy of buoyancy body 9 can be reduced. Apart from lowering the costs this will also result in the possibility of reducing the weight of clump weigh 11. The danger of collapsing the lower portion 6 which is present in the prior art device at the point where the fluid line contacts the seabed is eliminated because of the downwardly concave curve resulting from addition of buoyancy beads 8.

Although the invention has been described above relating to a preferred embodiment it has to be understood that many alternative embodiments are within the range of protection of the appended claims, e.g. it is possible to use the conduit for the transfer of hydraulic/electric signals. A trumpet or bend stiffener could be provided a one or more of the fixing points of She flexible conduit to control curvature.

We claim:

1. A fluid transfer system for an offshore moored floating unit (1) comprising a fluid line assembly (4) forming the fluid communication link between said floating unit and a seabed structure (3), said fluid line assembly comprising an upper catenary (5) extending from said floating unit to a subsurface buoy (7) moored to the seabed structure (3), and a lower flexible portion (6) extending from said subsurface buoy to said seabed structure at a point spaced a horizontal distance from said buoy, wherein said lower portion is provided with buoyancy means (8) between said point and said buoy at a horizontal distance from said buoy, said lower flexible portion (6) forming a catenary curve from said buoy (7) downwardly and then upwardly to said buoyancy means (8).

2. A fluid transfer system according to claim 1, wherein said lower portion has a greater extent (a) in horizontal direction than said upper catenary (b).

3. A fluid transfer system according to claim 1, wherein said fluid line assembly is provided with an upper connector (2) for connect/disconnect with said floating unit.

4. A fluid transfer system according to claim 1, wherein said buoyancy means comprises buoyancy beads.

5. A fluid transfer system according to claim 1, wherein the buoyancy body comprises a curved guiding channel (12) for receiving said fluid line.

6. A fluid transfer system according to claim 1, wherein said buoyancy means (8) is so positioned along said lower portion as to create, between said buoy (7) and said seabed structure, an upwardly concave portion of said fluid line assembly (4) closest to said buoy (7) and a downwardly concave portion of said fluid line assembly farther from said buoy (7).

* * * * *